US005562479A

United States Patent [19]

Pallas et al.

[11] Patent Number: 5,562,479

[45] Date of Patent: Oct. 8, 1996

[54] CONNECTOR FOR UNSHIELDED TWISTED WIRE PAIR CABLES

[75] Inventors: Constance R. Pallas, Parsippany Township, Morris County, N.J.; Clifford L. Winings, Lee's Summit, Mo.

[73] Assignee: AT&T Corp., Murray Hill, N.J.

[21] Appl. No.: 263,111

[22] Filed: Jun. 21, 1994

Related U.S. Application Data

[63] Continuation-in-part of Ser. No. 114,815, Aug. 31, 1993.

[51] Int. Cl.[6] ..... H01R 4/24

[52] U.S. Cl. ..... 439/404; 439/456; 439/894

[58] Field of Search ..... 439/607, 610, 439/578, 676, 894.1, 189, 79, 78, 84, 395–404, 456

[56] References Cited

U.S. PATENT DOCUMENTS

| | | | |
|---|---|---|---|
| 4,066,316 | 1/1978 | Rollings . | |
| 4,350,404 | 9/1982 | Clark et al. . | |
| 5,186,647 | 2/1993 | Denkmann et al. | 439/894.1 |
| 5,205,762 | 4/1993 | Corney | 439/108 |
| 5,226,835 | 7/1993 | Baker, III et al. | 439/894.1 |
| 5,282,754 | 2/1994 | Kish et al. | 439/108 |
| 5,299,956 | 4/1994 | Brownell et al. | 439/894.1 |
| 5,310,363 | 5/1994 | Brownell et al. | 439/894.1 |

FOREIGN PATENT DOCUMENTS

| | | |
|---|---|---|
| 0299487 | 1/1989 | European Pat. Off. . |
| 2271678 | 4/1994 | United Kingdom . |
| 2273397 | 6/1994 | United Kingdom . |
| 9408365 | 4/1994 | WIPO . |

OTHER PUBLICATIONS

C. S. Walker, "*Capacitance, Inductance and Crosstalk Analysis,* " (Artech House, 1990), pp. 66–71.

*Primary Examiner*—David L. Pirlot
*Attorney, Agent, or Firm*—Lester H. Birnbaum

[57] ABSTRACT

Disclosed is an electrical connector. A first section of the connector includes a portion for mating with another connector, A second section of the connector includes conductors in an essentially side-by-side alignment to produce crosstalk having a polarity opposite to that of the mating section.

10 Claims, 4 Drawing Sheets

CONNECTOR FOR UNSHIELDED TWISTED WIRE PAIR CABLES

This application is a continuation-in-part of application Ser. No. 08/114,815, filed on Aug. 31, 1993.

BACKGROUND OF THE INVENTION

This invention relates to electrical connectors.

Connectors of the type known as miniature ribbon style or telco connectors are typically used to provide electrical contact between cables including a plurality of unshielded twisted wire pairs. Such connectors usually comprise an insulative housing which includes two rows of contacts. One end of the contacts provides either a male or female mating section for electrical connection with another connector. The opposite ends of the contacts are formed into insulation displacement contacts which pierce the insulation of the twisted wire pairs to provide electrical contact thereto. The wire pairs are attached so that each wire in a pair is coupled to a different row of the array of contacts, and so that the wires rest in an essentially horizontal direction (i.e., parallel to the contacts). (See, e.g., U.S. Pat. No. 4,350,404 issued to Clark et al.)

It has also been suggested in some connector structures to have cable wire attached to insulation displacement contacts in a vertical direction (i.e., perpendicular to the contacts). (See, e.g., U.S. Pat. No. 4,066,316 issued to Rollings.)

Standards for crosstalk in connectors are becoming increasingly stringent. For example, in category 5 of the proposed EIA/TiA TSB40 Standard, it is required that a 25 pair ribbon cable connector exhibit near-end crosstalk which is less than 40 dB at 100 MHz using the standard power sum measurement. However, the mating section of the typical connector by itself does not meet this requirement. Thus, reducing crosstalk in other portions of the connector is not sufficient to provide a connector which conforms to this new performance standard.

SUMMARY OF THE INVENTION

The invention is an electrical connector comprising an insulative housing and a plurality of conductive members mounted therein. In one section, one end of each member is adapted for mating with another connector and in a second section an opposite end is adapted for providing electrical contact. The second section of the connector includes conductors formed in side-by-side alignment to provide crosstalk of a polarity which is opposite to that produced by the first section.

BRIEF DESCRIPTION OF THE DRAWING

These and other features of the invention are delineated in detail in the following description. In the drawing.

It will be appreciated that, for purposes of illustration, these figures are not necessarily drawn to scale.

DETAILED DESCRIPTION

Figure 1:
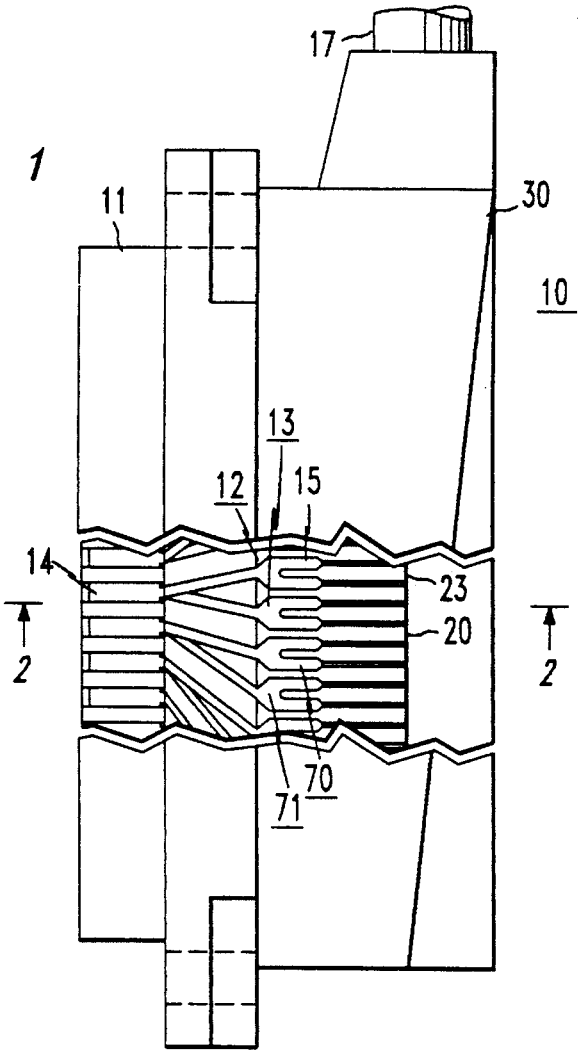
FIG. 1 is a top plan view, partly cut away, of a connector in accordance with an embodiment of the invention.
Figure 2:
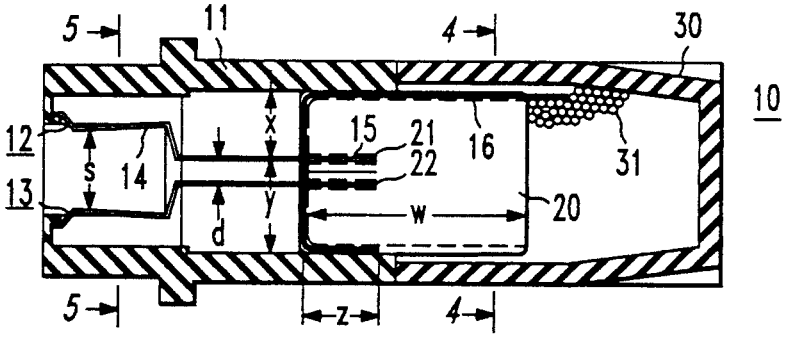
FIG. 2 is a cross-sectional view of the connector along line 2—2 of FIG. 1.
Figure 3:
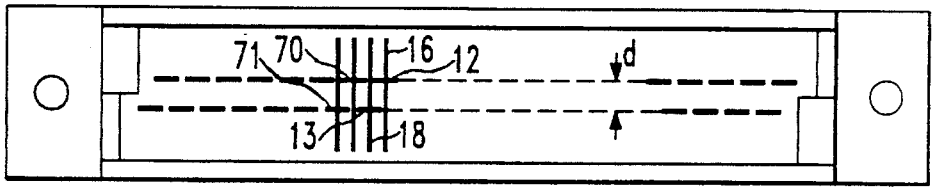
FIG. 3 is an end view of a portion of the connector of FIG. 1.

As illustrated in FIGS. 1–3, the connector, 10, in accordance with one embodiment, includes an insulating housing, 11, typically made of plastic. Mounted within the housing is an array of conductive members, e.g. 12, 13, 70 and 71. The conductive members are typically mounted within the housing in two rows. Each conductive member, e.g., 12, includes two opposite end portions. One end portion, e.g., 14, of each conductive member is shaped so as to form a mating section which is adapted for receiving and electrically contacting a similar plug-type connector (e.g., FIGS. 6–8). The opposite end portions, e.g., 15, are shaped to form insulation displacement contacts for electrically contacting wires, e.g., 16, from a cable, 17, which typically includes a plurality of twisted wire pairs. The conductive members are arranged so that opposite members, e.g., 12 and 13, in different rows contact the wires (16 and 18) of the twisted pairs (see FIG. 3).

It will be noted in this embodiment that the conductive members (e.g., 12 and 13) are bent inward so that the vertical distance, d, between the two rows of conductive elements at the contact portions (e.g., 15) is less than the vertical distance, S, at the mating portions (e.g., 14). Typically, d will be less than one-half of S. This configuration is advantageous for reasons to be discussed.

Also mounted within the housing, 11, adjacent to the contact potions (e.g, 15) of the conductive elements (e.g., 12 and 13) is a mandrel, 20, as shown in FIGS. 1 and 2. (The mandrel has been omitted from the view of FIG. 3 for purposes of illustrating the placement of the contact portions of the conductive elements.) The mandrel, 20, is made of an insulating material such as plastic, and is typically rectangular in cross section, but could be a variety of shapes. The mandrel extends essentially the full length of the connector and, desirably, includes a pair of slots 21 and 22 to accommodate the contact portions (e.g., 15) of both rows of the conductive elements (e.g., 12 and 13). The top, bottom and left-hand surfaces of the mandrel as viewed in FIG. 2 may also include grooves, e.g., 23, for positioning wires from each contact portion.

The width, w, and other dimensions of the mandrel, 20, play an important part in reducing the crosstalk of the connector. It is known that the mating sections of the conductive elements will produce a certain amount of crosstalk in the form of an induced voltage with one polarity, hereinafter referred to as "positive" crosstalk. However, the wires, e,g., 16 and 18, coupled to the contact portions are aligned side-by-side on the surface of the mandrel, 20, for a certain predetermined length (w+x+y+z). This alignment will produce a crosstalk in the form of induced voltage of the opposite polarity to that of the mating section crosstalk ("negative" crosstalk). This change in polarity of crosstalk is due to the fact that the wire pairs will all be aligned side-by-side in a: single plane over the mandrel (e.g., pair 16, 18 is in the same plane as pair 72, 73 in FIG. 4), while the pairs of conductive members coupled to each wire pair (e.g., pair 12, 13 connected to 16, 18 and pair 70, 71 connected to 72, 73) will be in essentially parallel planes having a different orientation in the mating section of the connector (e.g., as shown in FIG. 5).

For each section of the connector, the inductive crosstalk, $X_l$ (in volts), between any two pairs of conductors can be calculated according to the expression:

$$X_l = \frac{dI/dt}{2}\,(M_{ac} - M_{ad} + M_{bd} - M_{bc}) \tag{1}$$

where I is the current in one pair of conductors and $M_{ac}$, $M_{ad}$, $M_{bd}$, $M_{bc}$ are the mutual inductances from one conductor to another (i.e., assuming conductors a and b in one pair have current, I, applied thereto and conductors c and d in the other pair have an induced voltage).

The mutual inductance temps, $M_{xy}$ (in nH), can be approximated according to the expression:

$$M_{xy} = 5L\left[\ln\left[\frac{1}{r} + \sqrt{1 + \frac{1}{r^2}}\right] - \sqrt{1 + r^2} + r\right] \tag{2}$$

where L is the conductor length in the section (in inches) and r is the distance from conductor x to conductor y divided by the conductor length (L).

For each section of the connector, the capacitive crosstalk, $X_c$ (in volts), between any two pairs of conductors may be calculated according to the expression:

$$X_c = \frac{dV/dt}{2}\,(Z)\,(C_{cm}) \tag{3}$$

where V is the voltage on one pair of conductors, $C_m$ is the mutual capacitance between conductor pairs, and Z is the impedance terminating both the near-end and the far-end of the idle pair.

The capacitance value ($C_m$) is a function of the conductor shapes, spacings and lengths as well as the dielectric constants of the materials surrounding the conductors. Formulas are available for simple geometries (see, e.g., Charles S. Walker, *Capacitance, Inductance and Crosstalk Analysis,* (Artech House, 1990), pp. 66–71.

The near end crosstalk induced in an idle pair of conductors in any section by another pair of conductors is the sum of the inductive and capacitive crosstalk. The total near-end crosstalk in an idle pair in a section is calculated by the standard power sum method.

Therefore, each section of the connector will exhibit a different amount of crosstalk. The value of the crosstalk in the mandrel section will be negative when calculated according to the above. By choosing appropriate values for the dimensions (w, x, y) of the mandrel and for the wire length section (z), the crosstalk in this section can be made to nearly cancel out the positive crosstalk of the conductive members.

The appropriate dimensions may also be determined empirically by measuring the crosstalk for various dimensions.

Typically, the crosstalk in the conductive members was 39.5 dB between adjacent pairs at 100 MHz, while the crosstalk of the mandrel section was 40 dB of opposite polarity.

An appropriate choice of the dimensions, w, x, y and z, will therefore tend to cancel out the crosstalk produced by the conductive members. Bending the conductive members to place the members vertically closer together at the contact portions (making d less than S in FIG. 2) is advantageous in reducing crosstalk of the conductive members and thereby minimizing the predetermined distance required for side-by-side alignment of the wires. This is especially important where the contributions in crosstalk by conductor pairs beyond pairs adjacent to the idle pair contribute significantly to overall crosstalk. In a typical example, the distance w would be approximately 1.75 cm in accordance with the equations above. In general, distances in the range 1.0–2.0 cm should be useful.

A hood element, 30, snaps onto the housing, 11, to secure the mandrel, 20, in the housing and to provide a compartment for the twisted wire pairs 31. The wire pairs exit the hood where they are formed into one or more cables 17. The hood element is also, typically, made of plastic.

Figure 5:
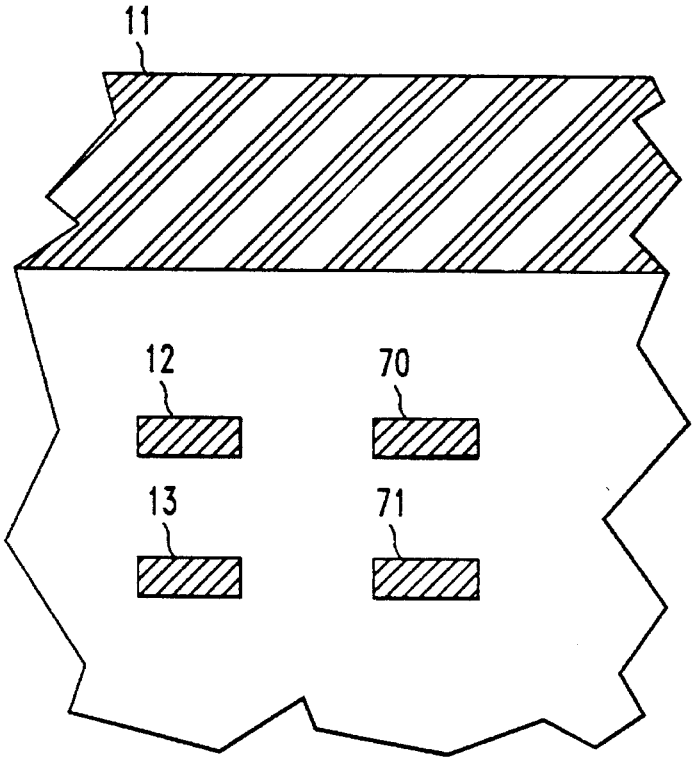
FIG. 5 is a view of a portion of the connector along lines 5—5 of FIG. 2.
Figure 6:
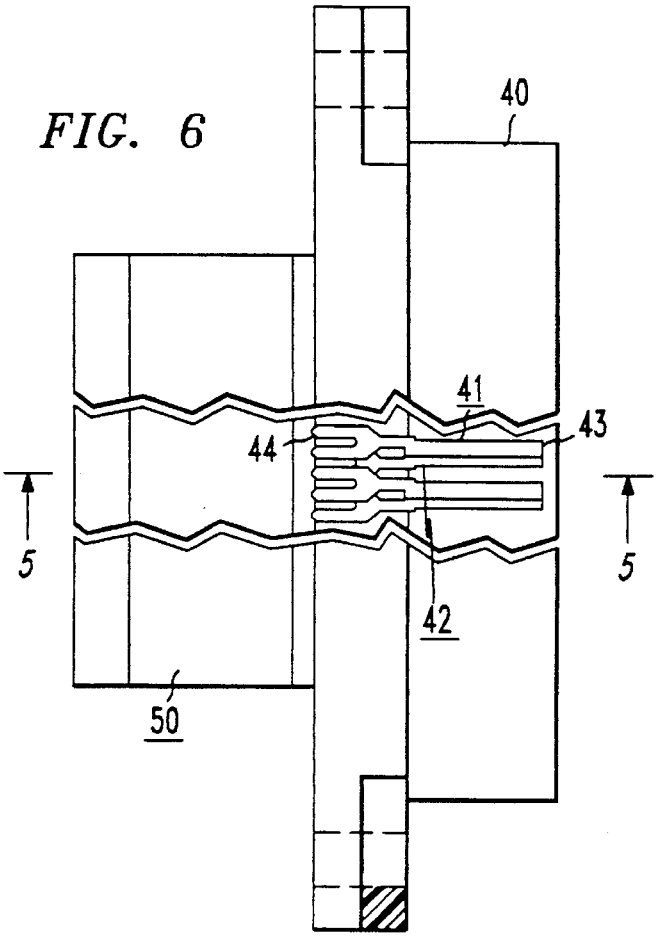
FIG. 6 is a top plan view, partly cut away, of a connector in accordance with a further embodiment of the invention.
Figure 7:
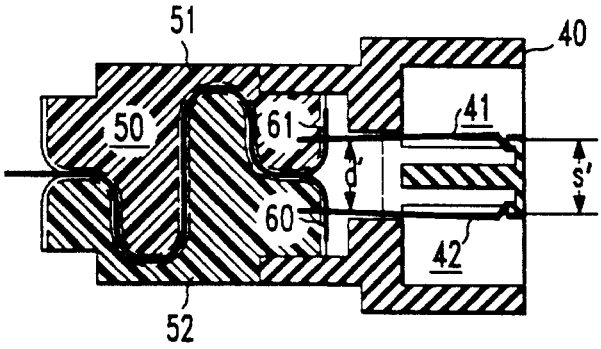
FIG. 7 is a cross-sectional view of the connector taken along line 7—7 of FIG. 4.
Figure 8:
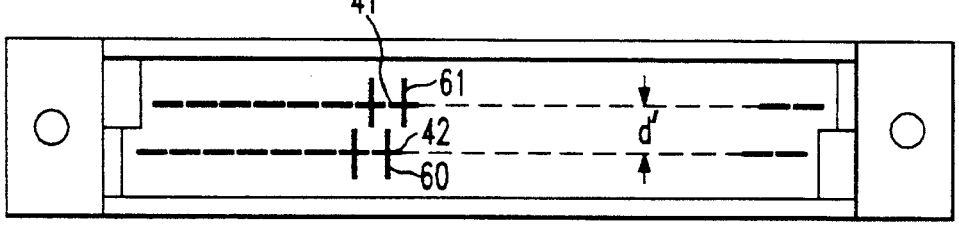
FIG. 8 is an end view of a portion of the connector of FIG. 4.

FIGS. 6–8 show an alternative embodiment of the invention. Again, an insulative housing, 40, includes two rows of conductive elements, e.g., 41 and 42, mounted therein. As before, each conductive element includes a mating portion, 43, at one end and an insulation displacement contact portion, 44, at the opposite end. One distinction here is that the mating portions form a plug connector which can fit, for example, into the receptacle connector of FIGS. 1–5. However, this embodiment can also be formed into a receptacle connector by appropriately shaping the mating portions as in FIGS. 1–2.

A further distinction lies in the fact that the spacing S' between mating portions of the different rows is essentially equal to the spacing d' between the contact portions of the two rows.

In this embodiment, the mandrel, 50, includes two parts, 51 and 52, with undulating surfaces which are complementary so that the parts fit together while allowing a meandering path for the wires, e.g., 60 and 61, from the twisted pair cable (not shown). One wire, e.g., 60, from each pair is connected to a conductive member, e.g., 42, in the bottom row, and the other wire, e.g., 61, from the pair is connected to a conductive member, e.g., 41, in the top row. (See also FIG. 8 where the mandrel has been removed for purposes of illustration.)

As in the previous embodiment, the wires will extend for a predetermined length in a side-by-side alignment determined by experiment or calculated from the equations above in order to compensate for the crosstalk generated by the mating portion of the conductive members. In this embodiment, the predetermined length is established by the path length of the undulating surfaces of the two parts 51 and 52. In a particular example, the path length is approximately 3.3 cm, but in general would range from 2.5–4.0 cm. The contact portions, e.g., 44, of the conductive members, e.g., 41 and 42, have approximately the same vertical spacing as the mating portions, e.g, 43 (i.e., S'=d') to allow for the bending of the wires (60, 61) between contacts. This spacing is made possible by the increased path length of the wires over the mandrel surface.

As before, a hood (not shown) snaps onto the housing in order to hold the mandrel and the twisted wire pairs.

While the invention has been described for cables including twisted wire pairs, it is also advantageous for any cable including balanced wire pairs. Also, while the wires are preferably perpendicular to the conductive members to produce a short connection, the invention may also be used where the wires are oriented at other angles, including the case where the wires are parallel to the conductive members at the point of contact.

While the invention is optimized by keeping the wires in side-by-side alignment over the mandrel surface, some misalignment or staggering of the wires could still result in sufficient negative crosstalk to be advantageous. In general, however, no wire should have a vertical distance (as viewed in FIG. 4) from any other wire which is greater than half the distance from the centerline of one pair to the centerline of the adjacent pair.

Figure 4:
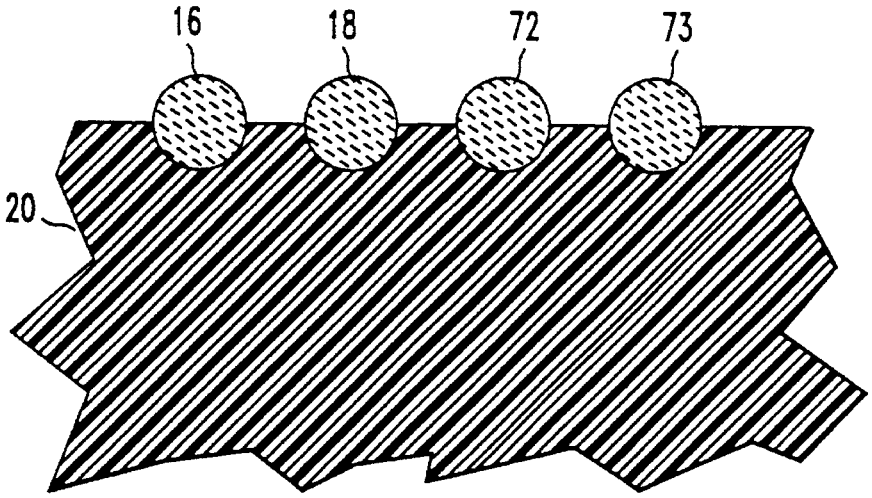
FIG. 4 is a view of a portion of the connector along lines 4—4 of FIG. 2.

Further, the wires need not be equally spaced from each other as shown in FIG. 4. Rather, varying the distance between wires can produce a greater negative crosstalk. In general, it is advantageous to have a distance between wires in a pair (e.g., 16, 18) at least equal to one-half the distance from the centerline of one pair (16, 18) to the centerline of an adjacent pair (72, 73).

It will also be appreciated that the stub length of each wire (dimension Z of FIG. 2) can also be used to control the amount of negative crosstalk.

Figure 9:
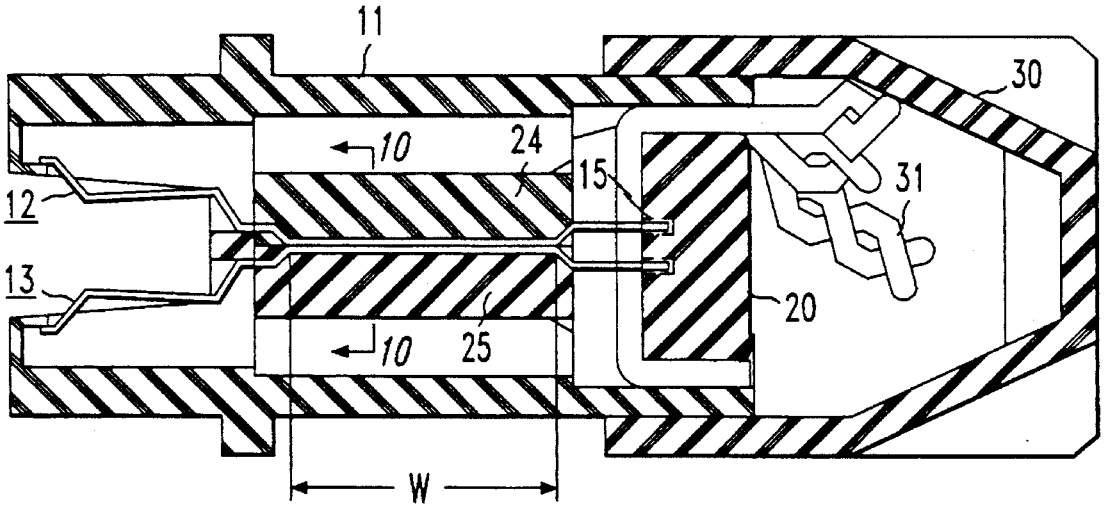
FIG. 9 is a cross-sectional view of a connector in accordance with a still further embodiment of the invention.

Finally, it should be understood that the invention in its broadest form is directed to providing a section of a connector which has a crosstalk of a polarity opposite to that of the mating portion of the connector. The use of a mandrel in that "compensation" section to keep the wires in side-by-side alignment is an advantageous embodiment of that principle. However, a similar effect could be produced as illustrated by the connector shown in FIGS. 9 and 10, where elements similar to FIGS. 1–5 are similarly numbered. Hence, while a mandrel, 20, is still used to connect the wires, e.g., 16, to their appropriate conductive members, e.g., 12, the conductive members themselves, e.g., 12, 13, 70 and 71, are bent so that they are in side-by-side alignment for some predetermined distance (w).

Figure 10:
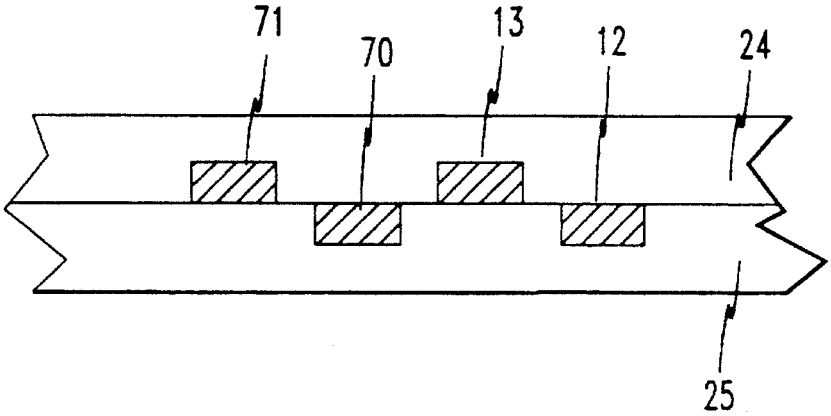
FIG. 10 is a cross-sectional view along line 10—10 of FIG. 9.

In this example, the conductive members (e.g., 12 and 13) coupled to each wire pair are insert molded into separate plastic members, 24 and 25, which plastic members are held together in the connector housing 11. As illustrated in FIG. 10, the conductive members need not be in perfect side-by-side alignment to produce a sufficient negative crosstalk as discussed regarding the previous embodiments. Alternatively, all the conductive members could be molded into a single plastic member. It will also be appreciated that all the conductive members (12, 13, 70 and 71) could be deposited on a surface of a printed circuit board in place of the plastic members 24 and 25. In fact, the mandrel, 20, and wires, e.g., 16, could be eliminated entirely so that the invention provides a means of mounting a connector to a printed circuit board while the conductive members on the board have a specified length and spacing to essentially cancel the crosstalk produced by the mating sections as previously discussed.

Nevertheless, it will be understood that the term "conductors" in the claims is intended to include conductive members (such as 12, 13), wires (such as 16, 18), and conductive members deposited on printed circuit boards within their scope.

Various additional modifications will become apparent to those skilled in the art. All such variations which basically rely on the teachings through which the invention has advanced the art are properly considered within the scope of the invention.

We claim:

1. An electrical connector comprising:

an insulative housing; and a plurality of conductive members mounted within the housing, one end of each member in a first section being adapted for mating with another connector and an opposite end of each member in a second section being adapted for providing electrical contacts, the conductive members in the first section being arranged in at least two rows of vertically aligned pairs and;

the second section including conductors positioned essentially in side-by-side alignment in a plane without crossover of any of the conductors, to provide crosstalk of a polarity which is opposite to that produced by the first section.

2. The connector according to claim 1 wherein the distance between the contact ends of the members of the two rows is less than the distance between the mating ends of the members of the two rows.

3. The connector according to claim 1 wherein the distance between the contact ends of the members of the two rows is essentially equal to the distance between the mating ends of the members of the two rows.

4. The connector according to claim 5 wherein the mandrel comprises two parts, and the surface of predetermined length comprises an undulating surface of one of the parts which is adjacent to a complementary undulating surface of the other part.

5. The connector according to claim 1 wherein the conductors are wires, and further comprising a mandrel in close proximity to one end of each member and having a surface of predetermined length on which each wire is laid so that each wire is in side-by-side alignment for the predetermined length.

6. The connector according to claim 5 further comprising a hood element mounted to the housing and enclosing the mandrel.

7. The connector according to claim 5 wherein the mandrel surface includes a plurality of grooves for aligning the wires with associated conductive members and maintaining spacing between the wires.

8. The connector according to claim 5 wherein the wires comprise a plurality of twisted wire pairs, and the spacing between wires in a pair is at least equal to one-half the distance between centerlines of adjacent pairs.

9. The connector according to claim 1 wherein the conductors in the second section are integral extensions of the conductive members in the first section.

10. The connector according to claim 9 wherein the conductive members are formed on a printed circuit board.

* * * * *